United States Patent [19]

Gilbert et al.

[11] Patent Number: 4,792,809

[45] Date of Patent: Dec. 20, 1988

[54] MICROSTRIP TEE-FED SLOT ANTENNA

[75] Inventors: Roland A. Gilbert, Milford, N.H.; Darrel F. Sedivec, Lawrence, Mass.

[73] Assignee: Sanders Associates, Inc., Nashua, N.H.

[21] Appl. No.: 856,874

[22] Filed: Apr. 28, 1986

[51] Int. Cl.[4] ..... H01Q 13/18

[52] U.S. Cl. ..... 343/770; 343/846

[58] Field of Search ..... 343/700 MS File, 846, 343/830, 829, 767–770

[56] References Cited

U.S. PATENT DOCUMENTS

| | | | |
|---|---|---|---|
| 2,885,676 | 5/1959 | Baldwin | 343/767 |
| 3,172,112 | 3/1965 | Seeley | 343/767 |
| 3,665,480 | 5/1972 | Fassett | 343/700 MS X |
| 3,978,487 | 8/1976 | Kaloi | 343/829 |
| 3,978,488 | 8/1976 | Kaloi | 343/829 |
| 4,017,864 | 4/1977 | Proctor | 343/767 |
| 4,040,060 | 8/1977 | Kaloi | 343/700 MS |
| 4,063,246 | 12/1977 | Greiser | 343/700 MS |
| 4,069,483 | 1/1978 | Kaloi | 343/700 MS |
| 4,072,951 | 2/1978 | Kaloi | 343/700 MS |
| 4,072,954 | 2/1978 | Comastri et al. | 343/713 |
| 4,083,046 | 4/1978 | Kaloi | 343/700 MS |
| 4,117,489 | 9/1978 | Kaloi | 343/700 MS |
| 4,138,684 | 2/1979 | Kerr | 343/846 |
| 4,197,544 | 4/1980 | Kaloi | 343/700 MS |
| 4,197,545 | 4/1980 | Favaloro et al. | 343/700 MS |
| 4,291,311 | 9/1981 | Kaloi | 343/700 MS |
| 4,291,312 | 9/1981 | Kaloi | 343/700 MS |
| 4,356,492 | 10/1982 | Kaloi | 343/700 |
| 4,370,657 | 1/1983 | Kaloi | 343/700 MS |
| 4,371,877 | 2/1983 | Doussot et al. | 343/846 X |
| 4,423,392 | 12/1983 | Wolfson | 333/116 |
| 4,477,813 | 10/1984 | Weiss | 343/700 MS |
| 4,531,130 | 7/1985 | Powers et al. | 343/700 MS X |
| 4,590,478 | 5/1986 | Powers et al. | 343/700 MS |

FOREIGN PATENT DOCUMENTS

| | | | |
|---|---|---|---|
| 16302 | 2/1981 | Japan | 343/767 |
| 113502 | 6/1985 | Japan | 343/767 |

*Primary Examiner*—Eugene R. Laroche
*Assistant Examiner*—Benny T. Lee
*Attorney, Agent, or Firm*—Richard I. Seligman

[57] ABSTRACT

A microstrip tee-fed slot antenna is made up of only a single printed circuit board having the tee feed and slot on the front side and a microstrip transmission line feed on the back side. A plurality of holes in the board surrounding the slot are electrically connected front to back to provide the antenna cavity. Since only a single board is used having all of the components of the antenna on either side, no disassembly is required to add to or modify the elements of the antenna.

9 Claims, 2 Drawing Sheets

MICROSTRIP TEE-FED SLOT ANTENNA

BACKGROUND OF THE INVENTION

This invention relates to antennas and, more particularly, to slot antennas which are fed from a microstrip transmission line.

Due to the high speed of modern aircraft and missiles, it is important that the size of protuberances from the surfaces of the craft be kept small, or possibly eliminated. Such craft usually have electronic equipment which requires antennas. Considerable work has been done toward reduction of the size of such antennas and mounting such antennas flush with the surface of the aircraft. Antennas employing a slot radiator are particularly useful for flush mounting as the slot is located flush with the skin of the craft and is backed by a cavity within the craft.

These slot antennas comprise a slot from which electromagnetic energy is radiated, a cavity, and a stripline probe for applying energy to the antenna in the cavity. The slot opening itself is usually not an actual opening which will create drag but rather is a sheet of dielectric material flush with the hull. The dimensions of the radiating slot antennas are generally determined by bandwidth and operating frequency. In order to obtain good directivity and gain, it is often necessary to employ an array of these slot antennas. The use of an array of slot antennas also lends itself to beam steering by controlling the phasing of the energy applied to the probe behind each slot.

One typical slot antenna is shown in FIG. 1 of the drawings and is the subject of U.S. Pat. No. 4,197,545, assigned to the assignee of this application. This antenna is made up of three boards, 10, 12 and 14. The top board 10 is made up of a dielectric material 11 having a layer of copper 13 bonded on the upper surface thereof, and includes a rectangular area 15 where the copper is etched away. Board 10 also includes a plurality of holes 17 located about the rectangular area 15 to define the boundaries of a cavity. The middle board 12 is made up of a dielectric material having a copper "T" section 18 bonded thereon with two holes 19 and 21 at the ends of the arms of the "T". Lower board 14 is a dielectric 23 having a copper layer 25 on the bottom. Boards 12 and 14 also have holes 17 therein aligned with the holes 17 in board 10. Holes 19 and 21 in board 12 are also aligned with like holes in boards 10 and 14. When the antenna is assembled, the boards 10, 12 and 14 are sandwiched together and fastened by, for example, gluing, using rivets, or other connecting means. Connecting pins are also placed through all of the holes 17 (and holes 19 and 21) in each of the three boards to connect the three boards mechanically and electrically. These connecting pins may be rivets or other fastening means, or plated-through holes of the type commonly used in printed circuit technology.

In operation, radio frequency energy is applied to the antenna via a path 27 to the top arms of the tee probe 18, which arms are terminated via holes 19 and 21 through the connecting pins mentioned previously. In actual operation the ends of the tee probe arms at the holes 19,21 will be at ground potential due to the rivets or plated-through holes which connect the arms to surface 13 of board 10 and surface 25 of board 14. When a slotted plate, such as plate 10, is excited by the radio frequency energy applied to path 27 of board 12, the slot acts analogous to a magnetic dipole antenna and radiation will be emitted from the dielectric area 15 on board 10. Further information regarding this type of antenna may be had by reference to said U.S. Pat. No. 4,197,545, the entire disclosure of which is incorporated herein by reference.

In an alternate embodiment of a slot antenna similar to this antenna, only two layers of printed circuit boards are used, with the middle layer 12 eliminated and instead the tee probe 18 is applied to the top layer of board 14. Such an antenna is described in U.S. Pat. No. 4,562,416, the entire disclosure of which is incorporated herein by reference.

These antennas provide excellent performance, however, they are expensive to construct and have problems when, after construction, changes have to made thereto. This is particularly true when a number of such elements as described in FIG. 1 are used together in an array. One of the problems with a multiple board antenna of these types is that when the layers are fastened together it is essential that there be no air pockets between the dielectrics, otherwise the characteristics of the antenna will change in an unpredictable fashion.

Another problem is that, if the antenna is already assembled and there is a problem such as the desire to add tuning stubs, etc., it is very difficult to disassemble the antenna. For example, if one wanted to add a tuning stub 29 (shown in dashed lines) to the feed 27 shown in FIG. 1, one would have to disassemble the antenna, add the tuning stub, and would not be able to determine the effect of the tuning stub until the antenna is reassembled. If the tuning stub does not provide the desired results, then it would have to be disassembled and adjustments again made. This might have to be done a number of times until the desired results are obtained.

For large antenna groups a minor error in only a single element could be corrected only by disassembly of the entire array.

Antennas using multiple layers are also thicker and more expensive to manufacture.

Accordingly, it is an object of this invention to provide an improved antenna.

It is another object of this invention to provide an improved slot antenna made up of only a single board.

It is a further object of this invention to provide an improved slot antenna in which all the elements of the antenna are exposed so as to permit easy access to the components to make changes to them.

SUMMARY OF THE INVENTION

Briefly, a single board slot antenna which is fed by a microstrip transmission line is provided. The front side of the board includes a copper layer having a slot therein with a cross member of copper in the slot connected at the ends thereof to the rest of the copper layer and, thus, forming the arms of a tee. A plurality of holes surround the slot to form the boundaries of the cavity for the antenna.

The bottom side of the board includes a copper section also having holes therein to form the boundaries of the cavity and having a section of the copper removed to provide an entranceway for a microstrip transmission line feed to the cavity of the antenna. The holes forming the cavity are connected together using connecting pins, rivets, plated-through holes, or the like. Also, a connecting pin is provided between the end of the microstrip transmission line on the back of the antenna and the tee on the front side of the antenna.

It is seen by this arrangement that all of the components of the antenna are on one side of the board or the other. No multiple boards have to be assembled. If any changes have to be made to the antenna, they can be made from either the front or back side which are both exposed. For example, in this embodiment, if a shorting stub was to be added to the microstrip feed, it could merely be provided on the back side of the antenna without any disassembly required.

BRIEF DESCRIPTION OF THE DRAWINGS

The above mentioned and other features and objects of this invention will become more apparent by reference to the following description taken in conjunction with the accompanying drawings, in which.

DESCRIPTION OF A PREFERRED EMBODIMENT

Figure 2:
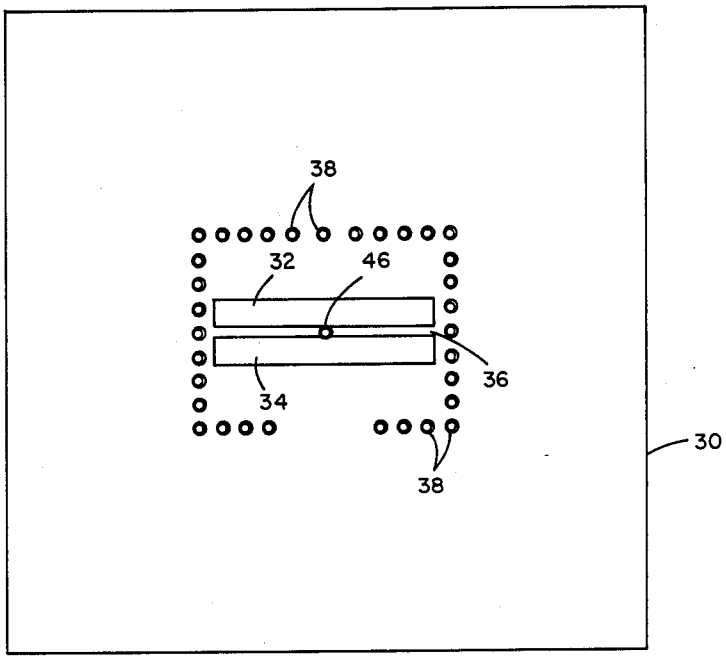
FIG. 2 is a plan view of the front side of a microstrip tee-fed slot antenna configured according to the principles of this invention.
Figure 3:
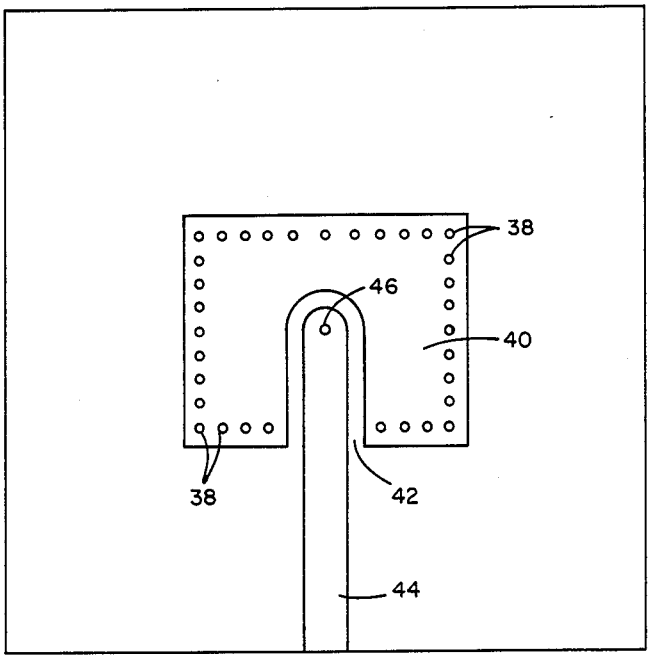
FIG. 3 is a plan view of the backside of the antenna of FIG. 2.

Referring now to FIGS. 2 and 3 of the drawings, there is illustrated thereby an embodiment of a microstrip transmission line tee-fed slot antenna. Although only one antenna element is shown, the principles of the invention can be used to provide arrays of antenna elements each configured similar to the antenna element of FIGS. 2 and 3. The antenna according to his invention is constructed using only a single printed circuit board. FIG. 2 shows the front side of the board and FIG. 3 shows the back side of the board. The board is typically made of a low-loss dielectric material of the type used in fabricating printed circuit boards.

Figure 1:
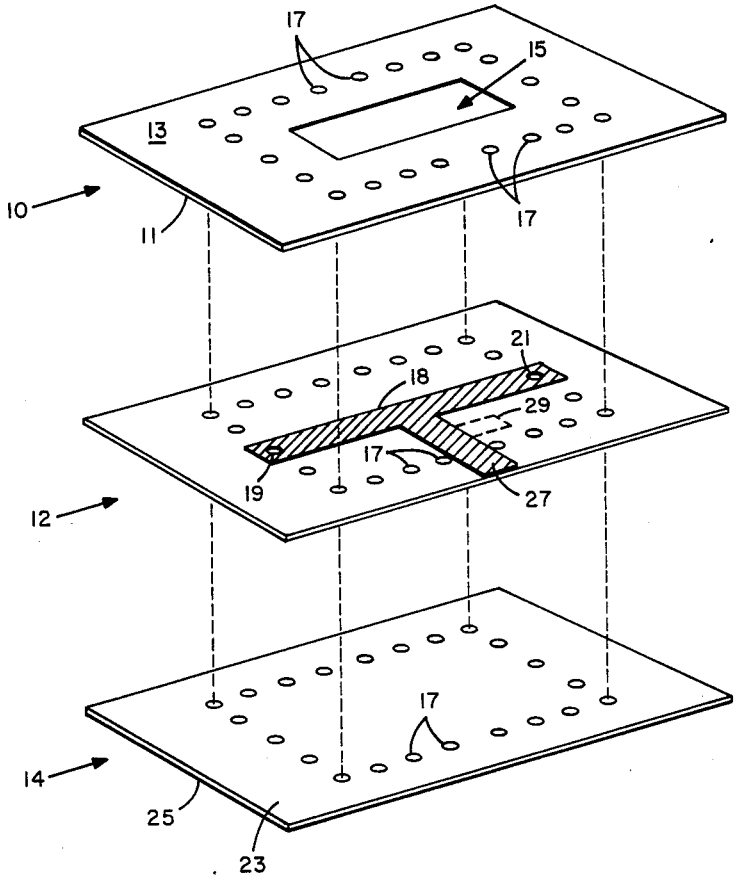
FIG. 1 (PRIOR ART)
FIG. 1 is an exploded perspective view of a prior art stripline slot antenna.

The front of the board, as shown in FIG. 2, has a layer of copper 30 over the entire surface thereof except for two rectangular areas 32 and 34 which comprise the slot for the slot antenna. The portion of the surface 36 intermediate the two rectangular areas 32 and 34 is the tee feed for the slot antenna. The tee feed is made of the same material as the rest of the board and comprises the same copper deposition. That is, this surface of the antenna is made by depositing copper on the dielectric board and etching away the rectangles 32 and 34. The ends of the tee feed are shorted to the rest of the board inherently by this construction process. Note that in the prior art embodiment of FIG. 1, it was necessary to use connecting pins or the like at the ends of the arms of the tee to provide shorting to the ground plane. Arranged about the slot, formed by the rectangular areas 32 and 34, are a plurality of shorting pins, rivets or plated-through holes 38 which define the periphery of the cavity for the antenna. If desired, the entire surface 30 need not have copper thereon but only the area defined by the pins 38. However, if the antenna is to be used as a single element, it is desirable to leave the copper cladding on the board. Also, for minimizing radar cross-section and proper operation of the antenna, it is preferred that the entire surface 30 have a copper layer thereon.

The bottom of the board is shown in FIG. 3 and comprises a copper section 40 surrounding the shorting pins, rivets or plated-through holes 38 and providing one ground plane for the antenna. If desired, however, a larger surface of the backside of the antenna may have a copper deposition. However, it is only necessary that the areas forming the cavity be of copper. The copper surface 40 has a cut-out section 42 therein where copper is removed and in the middle of which is provided a microstrip transmission line 44 for feeding energy to the antenna. A pin 46 is provided at the top of the microstrip transmission line for providing a shorting connection between this portion of the microstrip element and the tee in the front of the antenna. Also, the pins 38 make the connections between the front and back sides of the antenna. In constructing this board, typically both sides of the board have copper depositions thereon and the copper is etched to provide the slot made up of rectangular sections 32, 34, the area 42 surrounding the microstrip feed 44 and any other areas of the antenna where copper is removed.

It is apparent that by using this configuration changes can be readily made to the antenna, such as adding phase shifters, tuning stubs, couplers, etc., without any disassembly since all of the elements of the antenna are exposed. This must be contrasted to the prior art antennas wherein the antennas were made up of multiple layer boards and the feed, for example, located in the middle of the multilayer boards, could only be accessed by disassembly of the antenna. Since all of the elements are exposed, changes can be made thereto even when the antenna is radiating.

While we have described above the principles of our invention in connection with specific apparatus, it is to be clearly understood that this description is made only by way of example and not as a limitation of the scope of our invention as set forth in the accompanying claims.

We claim:

1. A tee-fed slot antenna, comprising:

a board having a front side and a back side and made up of a dielectric material having a first electrically conductive layer bonded to the front side thereof with a portion of said electrically conductive layer removed to form two non-conducting areas separated by a conducting area comprising the arms of a tee in the middle of said two non-conducting areas;

said board also having a second electrically conductive layer bonded to the back side thereof with a portion of said electrically conductive layer removed to form an elongated non-conducting cavity entrance;

a plurality of connecting means, for connecting said first and second conductive layers, disposed around and spaced from said two non-conducting areas to define a cavity therewithin, and having the elongated cavity entrance extending from one ege of the cavity into said cavity; and a planar transmission line disposed on the back side of said board, said transmission line extending within the cavity entrance and having one end thereof electrically connected to the tee.

2. A tee-fed slot antenna as defined in claim 1, wherein said transmission line is a microstrip transmission line.

3. A tee-fed slot antenna as defined in claim 1, wherein said connecting means are plated-through holes.

4. A tee-fed slot antenna as defined in claim 1, wherein said connecting means are rivets.

5. A tee-fed slot antenna as defined in claim 1, wherein the two non-conducting areas are of equal size.

6. A tee-fed slot antenna, comprising:

a single board with opposing sides and having electrically conductive layers on said opposing sides and a dielectric layer intermediate said electrically conductive layers;

said board having a portion of said electrically conductive layer on one side thereof removed to form two non-conducting areas separated by a conducting area;

means for connecting said electrically conductive layers to form a cavity about said two non-conducting areas;

said board also having a portion of said electrically conductive layer on the other side thereof remove to form an elongated entranceway extending into said cavity from one edge thereof; and a planar transmission line disposed in the entranceway to feed energy to this cavity with said transmission line extending to and electrically connected to said conducting area intermediate said two-non-conducting areas.

7. A tee-fed slot antenna as defined in claim 5, wherein said transmission line is a microstrip transmission line.

8. A tee-fed slot antenna as defined in claim 5, wherein the two non-conducting areas are of equal size.

9. A method of constructing a tee-fed slot antenna, comprising the steps of:

providing a layer of dielectric material having conductive material on both sides thereof;

removing portions of the conductive material from one side to form two non-conducting areas separated by a conducting area;

electrically connecting portions of the one side of the conductive material to portions of the other side of the conductive material to form a cavity;

removing a portion of the conductive material from the other side to form a microstrip transmission line and elongated entranceway extending into the cavity from an edge thereof; and electrically connecting the transmission line and the conducting area between the two non-conducting areas.

* * * * *